US005603408A

United States Patent [19]

Protz, Jr.

[11] Patent Number: 5,603,408

[45] Date of Patent: Feb. 18, 1997

[54] INSERT FOR BLISTER PACKAGE

[75] Inventor: William F. Protz, Jr., Lake Forest, Ill.

[73] Assignee: Santa's Best, Northfield, Ill.

[21] Appl. No.: 519,926

[22] Filed: Aug. 28, 1995

[51] Int. Cl.[6] ..... B65D 73/00

[52] U.S. Cl. ..... 206/461

[58] Field of Search ..... 206/461, 464, 206/465, 471, 462, 459.5

[56] References Cited

U.S. PATENT DOCUMENTS

| | | | |
|---|---|---|---|
| 3,093,244 | 6/1963 | Middleton, Jr. et al. | 206/461 X |
| 3,358,824 | 12/1967 | Stagnitto | 206/461 X |
| 3,428,171 | 2/1969 | Blish | 206/461 X |
| 3,939,979 | 2/1976 | Neumayer | 206/461 |
| 4,014,134 | 3/1977 | Womack, Jr. | 206/461 X |
| 4,261,462 | 4/1981 | Wysocki | 206/462 X |
| 5,020,669 | 6/1991 | Nakagoshi | 206/461 X |

*Primary Examiner*—Bryon P. Gehman
*Attorney, Agent, or Firm*—Emrich & Dithmar

[57] ABSTRACT

A blister package for displaying loose product having a backing sheet and a transparent plastic cover having a flange for connection to the backing sheet. An insert having a shape partly complimentary to a portion of the plastic cover is positioned inside and adjacent the plastic cover and maintained in position. The plastic cover is a predetermined distance away from the backing sheet to define a storage space to accommodate loose product in the storage space visible through the plastic cover.

8 Claims, 3 Drawing Sheets

INSERT FOR BLISTER PACKAGE

BACKGROUND OF THE INVENTION

This invention relates to the packaging industry and more particularly to packaging of the type that hangs in hardware stores, drug stores and the like in which the product to be sold is visible inside the packaging. Packaging of this type is commonly known as blister packaging. One of the problems associated with blister packaging and particularly with blister packaging which contains loose product is that the product tends to settle towards the bottom of the blister package and consumers think they are being cheated or at least feel there should be more product. Another problem with blister packaging is the location of advertising and other indicia informing the public as to the nature and characteristics of the product in the packaging. Because shelf space is a premium item in stores, blister packages cannot be made too large, and accordingly, the space available for advertising is extremely limited.

SUMMARY OF THE INVENTION

Accordingly, it is a principal object of the present invention to provide a new and improved blister package for displaying loose product.

Another object of the present invention is to provide a new and improved blister package for displaying loose product in which a paper insert is positioned inside the blister package providing an area for advertising while at the same time hiding settling of the product.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
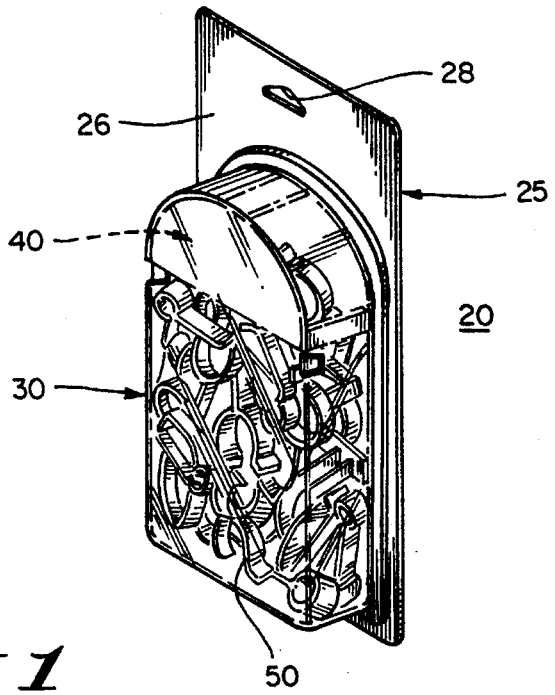
FIG. 1 is a perspective view of a blister package made in accordance with the present invention.
Figure 2:
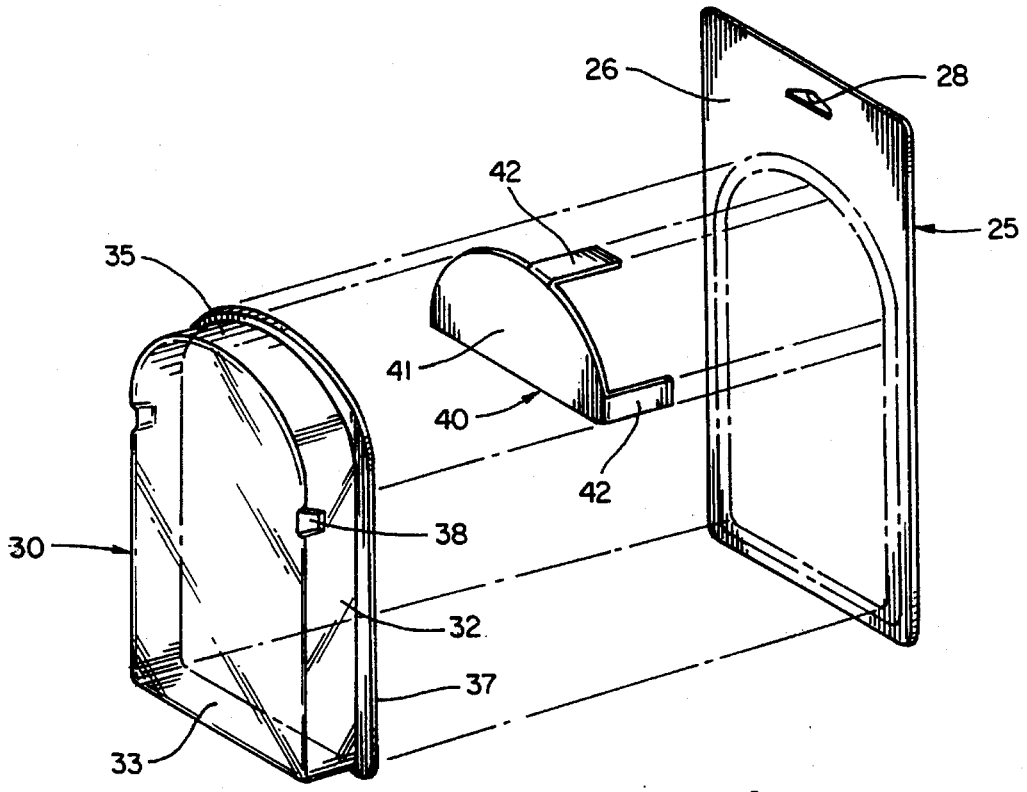
FIG. 2 is an exploded view of the blister package illustrated in FIG. 1 without the product being shown.
Figure 3:
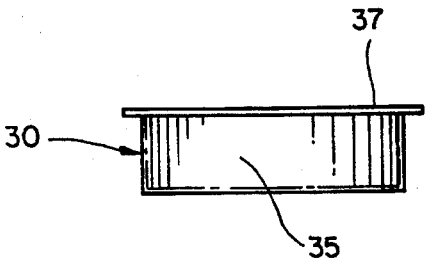
FIG. 3 is a top plan view of the package illustrated in FIG. 1 without the product.
Figure 4:
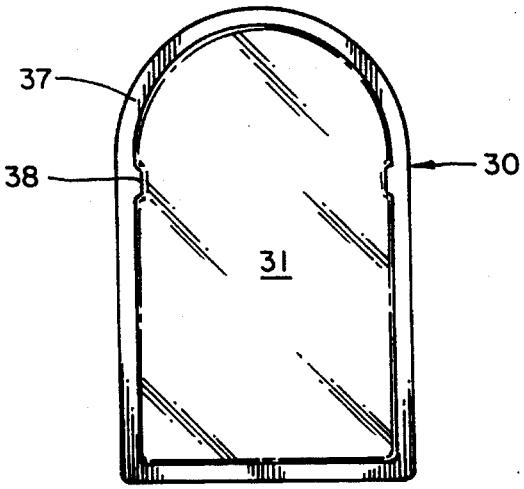
FIG. 4 is a front elevational view of the blister package illustrated in FIG. 3.
Figure 5:
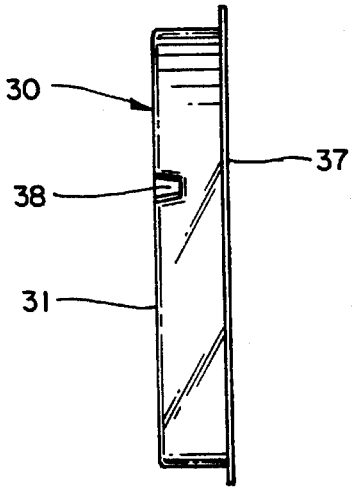
FIG. 5 is side elevational view of the blister package illustrated in FIG. 3.
Figure 6:
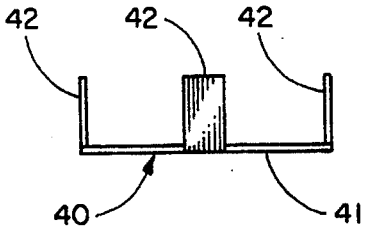
FIG. 6 is a top elevational view of the spacer illustrated in FIG. 2.
Figure 7:
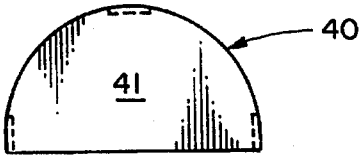
FIG. 7 is a front elevational view of the spacer illustrated in FIG. 6.
Figure 8:
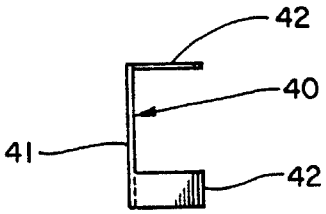
FIG. 8 is a right side elevational view of the spacer illustrated in FIG. 6.
Figure 9:
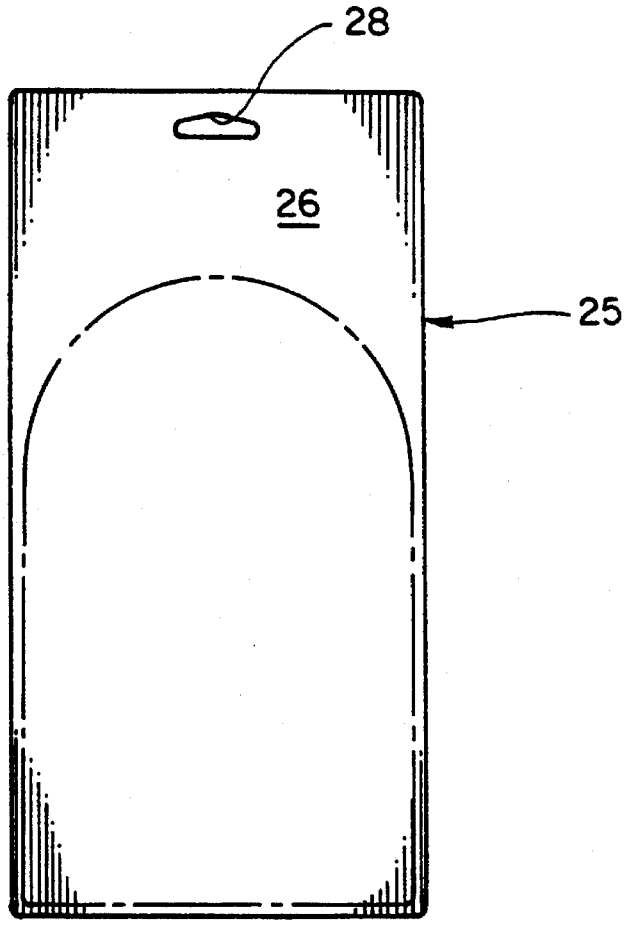
FIG. 9 is a front elevational view of the backing sheet of the blister package illustrated in FIG. 1.
Figure 10:
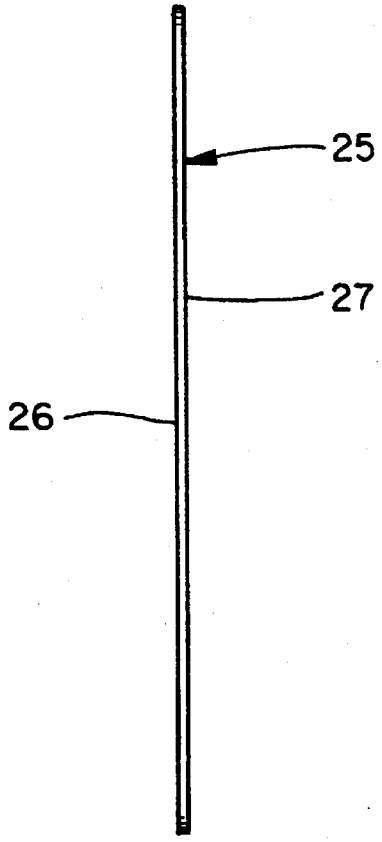
FIG. 10 is a right side elevational view of the blister package backing sheet illustrated in FIG. 9.

Referring now to the drawings, there is disclosed in FIGS. 1–10 a blister package 20 consisting of a flat backing sheet 25 having a front surface 26 and a rear surface 27, the backing sheet 25 having an aperture 28 near the top center portion thereof.

A transparent plastic cover 30 is shaped to fit over a portion of the backing sheet 25 and includes a front face 31 having side edge portions 32 and a bottom edge portion 33. Side edge portions 32 are interconnected by a top arcuate edge portion 35. A flange 37 extends generally perpendicularly from the plane of the side edge portions 32 and the top edge portion 35 for mounting to the front face 26 of the backing sheet 25. A pair of spear-shaped ledges 38 extend inwardly from each of the side edge portions 32 for a purpose hereinafter set forth.

An insert 40 which may be of any printable relatively stiff opaque material is generally semi-circular in shape and has a front surface 41 and a rear surface from which extends three legs 42 generally perpendicular to the front surface 41 of the insert 40, the legs 42 serving as spacer mechanisms for insuring the location of the insert 40 with respect to the top edge portion 35 of the cover 30. The insert 40 rests on the ledges 38 when positioned inside the cover 30 to prevent the insert 40 from moving downwardly from the position illustrated.

Loose product 50 is retained in the blister package 20 between the backing sheet 25 and more particularly the front surface 26 thereof and the cover 30 and more particularly the front surface 31 thereof and the side edge portions 32 thereof when the flange 37 of the cover 30 is connected to the front surface 26 of the backing sheet 25 by suitable means such as an adhesive.

An important advantage of the present invention is that various advertising indicia or other items of interest may be written, printed, or otherwise presented on the front surface 41 of the insert 40 which indicia, advertising or other printed material is visible through the transparent front face 31 of the cover 30. The insert 40 is maintained in its appropriate location by cooperation of the legs 42 with the backing sheet 25 and the spear-shaped ledges 38 contacting the bottom of the side legs 42.

As before indicated, the benefit of the invention of the present design is in the additional advertising space provided by the front surface 41 of the spacer 40 and by the concealment of the settling aspect of the loose product 50 in the cover 30.

While there has been described herein what is considered to be the preferred embodiment of the present invention, various modifications and alterations made therein without departing from the true spirit of the invention and as it is intended to cover in the appended claims all such variations and modifications.

What is claimed is:

1. A blister package displaying loose product, comprising a backing sheet, a transparent plastic cover extending outwardly from said backing sheet defining a storage space for the loose product and having a flange extending substantially around said plastic cover parallel to said backing sheet for connection to said backing sheet, and an insert having a shape at least in part complimentary to a portion of said plastic cover positioned inside and adjacent said plastic cover, said insert having a plurality of spaced apart leg members extending perpendicularly to said backing sheet for maintaining said insert adjacent said plastic cover and away from said backing sheet, said plastic cover having locating members extending interiorly thereof cooperating with said spaced apart leg members to locate and maintain said insert with respect to said plastic cover, said plastic cover being a predetermined distance away from said backing sheet defining a storage space, and loose product in the storage space visible through said plastic cover.

2. The blister package of claim 1, wherein said plastic cover has an arcuate top portion extending through about 180° of arc and a flat bottom portion interconnected by side portions substantially perpendicular to said bottom portion.

3. The blister package of claim 2, wherein said plastic cover has a flat front portion integral with said side portions, said side portions extending outwardly from said front portion a distance in the range from about three-fourth of an inch to not more than three inches.

4. The blister package of claim 2, wherein said insert is paper and is positioned in said storage space and has an arcuate top portion extending through about 180° of arc.

5. The blister package of claim 4 wherein said paper insert leg members are weakened at the junctures of said leg members and insert.

6. The blister package of claim 4 wherein said paper insert is opaque and carries indicia thereon.

7. The blister package of claim 4, wherein said plastic cover is a polyvinyl chloride material.

8. The blister package of claim 4 wherein said locating members and said spaced apart leg members maintain said insert at the top of said blister package.

* * * * *